US010544602B1

(12) United States Patent
Alvarado

(10) Patent No.: US 10,544,602 B1
(45) Date of Patent: Jan. 28, 2020

(54) TWO-PIECE STRIKER PLATE

(71) Applicant: Ernesto J. Alvarado, Fort Worth, TX (US)

(72) Inventor: Ernesto J. Alvarado, Fort Worth, TX (US)

( * ) Notice: Subject to any disclaimer, the term of this patent is extended or adjusted under 35 U.S.C. 154(b) by 0 days.

(21) Appl. No.: 16/100,845

(22) Filed: Aug. 10, 2018

Related U.S. Application Data

(63) Continuation-in-part of application No. 15/296,460, filed on Oct. 18, 2016.

(51) Int. Cl.
*E05B 15/00* (2006.01)
*E05B 15/02* (2006.01)

(52) U.S. Cl.
CPC ..... *E05B 15/025* (2013.01)

(58) Field of Classification Search
CPC ..... E05B 15/025
See application file for complete search history.

(56) References Cited

U.S. PATENT DOCUMENTS 633,918 A 9/1899 Smith
749,818 A 1/1904 Hamel
1,272,115 A * 7/1918 Russell ..... E05B 15/0245 292/341.19
1,295,458 A 2/1919 Erffmeyer
2,153,080 A 4/1939 Flora
2,439,036 A * 4/1948 Bohnsack ..... E05B 15/0245 292/341.18
4,105,235 A * 8/1978 Thiel ..... E05B 15/0245 292/341.18
4,305,611 A 12/1981 Robins
5,118,151 A 6/1992 Nicholas, Jr. et al.
5,127,690 A * 7/1992 Kim ..... E05B 15/0245 292/340
8,439,410 B2 * 5/2013 Sauder ..... E05B 15/0245 292/340
9,932,755 B2 * 4/2018 Niccole ..... E05B 17/2003

OTHER PUBLICATIONS

"Home depot adjustable strike plate" search on https://www.homedepot.com yielding 8 results.
Deltana SP2751U3 polished brass strike plate found on https://www.build.com.

* cited by examiner

*Primary Examiner* — Kristina R Fulton
*Assistant Examiner* — Thomas L Neubauer
(74) *Attorney, Agent, or Firm* — James E. Walton

(57) ABSTRACT

A system and method for adjusting the location of the striker plate relative to the throw of a lock includes two plates, and upper plate and a lower plate, that adjustably translate relative to each other. The lower plate is affixed to a door jamb and the other plate slides relative to the upper plate. This adjustable striker plate system provides users with the ability to relocate the upper plate over time to compensate for different locks on the door, or movement of the door jamb over time.

4 Claims, 8 Drawing Sheets

TWO-PIECE STRIKER PLATE

This application is a continuation-in-part of U.S. patent application Ser. No. 15/296,460, filed 18 Oct. 2016, entitled "Two-Piece Striker Plate," which is incorporated herein for all purposes.

BACKGROUND

1. Field of the Invention

The present invention relates in general to the field of striker plates for door locks and more specifically to adjustable striker plates for entry doors.

2. Description of Related Art

Entry doors are typically locked to prevent access. The door is hinged in a jamb with a handset located opposite the hinged edge of the door. During the installation of the door a strike plate is installed into the jamb. The strike plate features an opening configured to receive the throw from the handset. The jamb is drilled behind the opening in the strike plate to allow the throw of the handset to extend fully. The strike plate is screwed into the jamb. The metallic strike plate prevents the wooden jamb from failing when a large force is applied to the door. The opening in the jamb is based upon the throw of the handset or lock. Over time doors and handsets are typically replaced. As they are replaced the position of the opening in the jamb moves. Conventionally the size of the opening in the jamb is increased and the strike plate relocated to coordinate with the location of the new throw. This weakens the door as the size of the opening grows and grows. Additionally, the fasteners securing the strike plate to the jamb have less material to be retained by as the opening grows.

One solution to the issue is replacing the jamb. However, replacing the jamb requires a substantial amount of work to accomplish. Another solution is to fill the existing opening in the jamb and drill a new opening. Filling the existing hole requires time for the patch to cure properly. While there are many striker plates known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

and

Figure 6A:
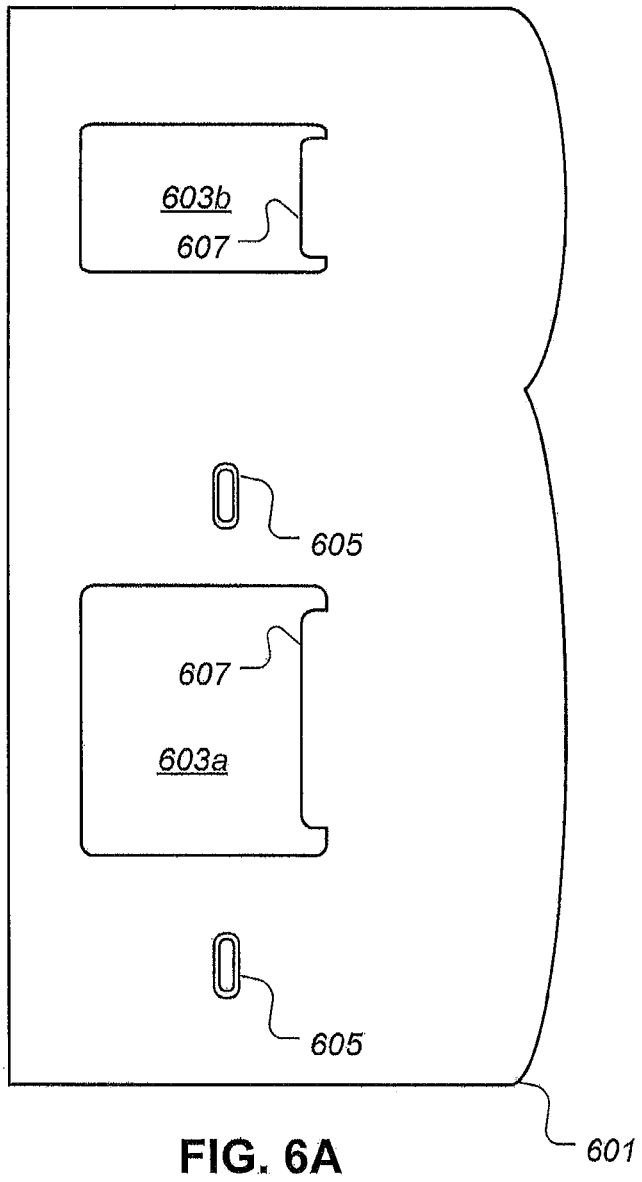
FIG. 6A is a front view of an alternative top plate according to the present application.
Figure 6B:
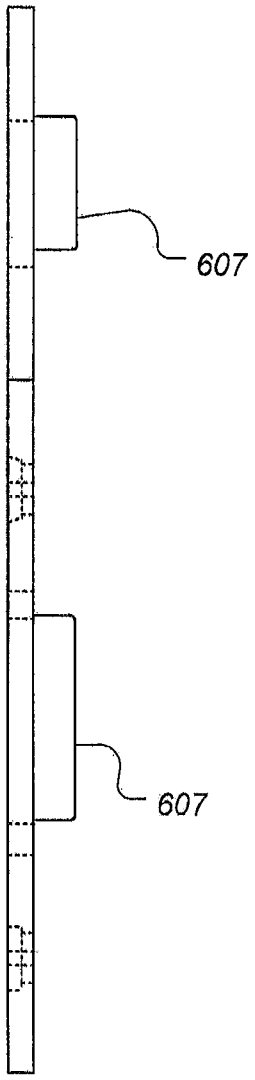
FIG. 6B is a side view of an alternative top plate according to the present application.
Figure 6C:
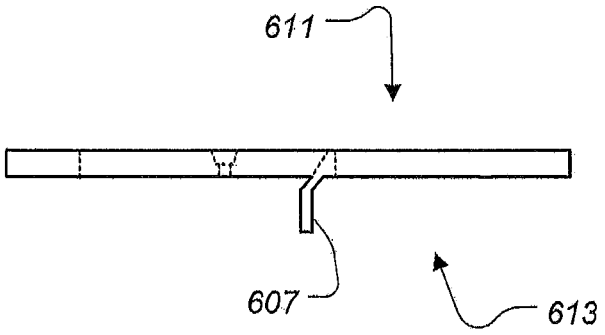

FIG. 6C is an end view of an alternative top plate according to the present application.

Figure 7A:
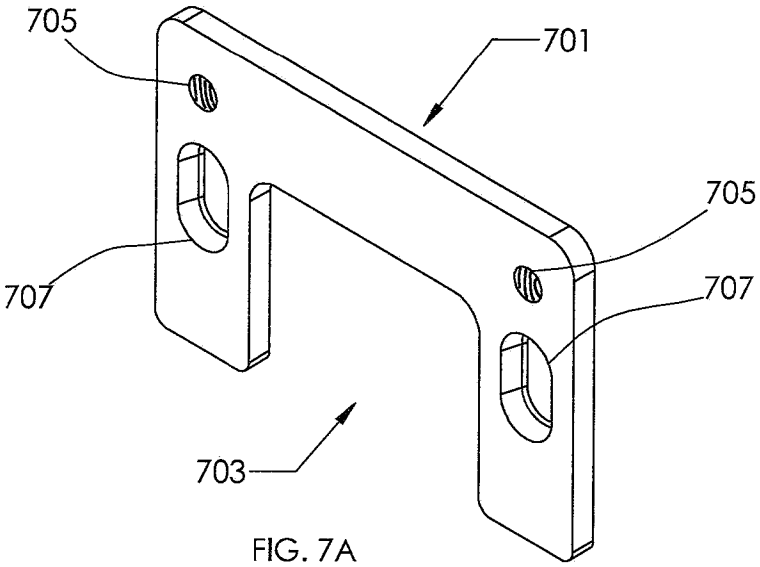
Figure 7B:
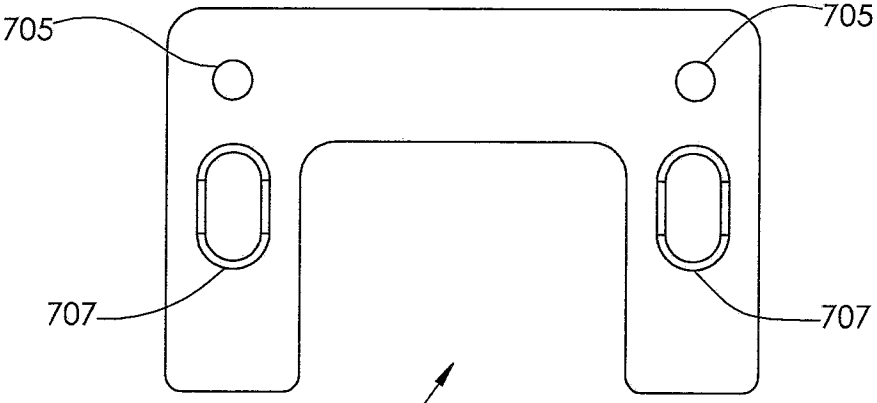
Figure 7C:
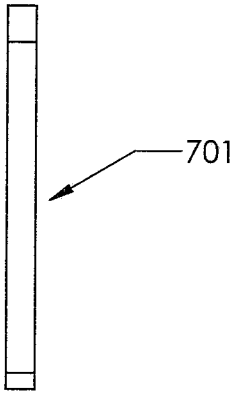
Figure 8A:
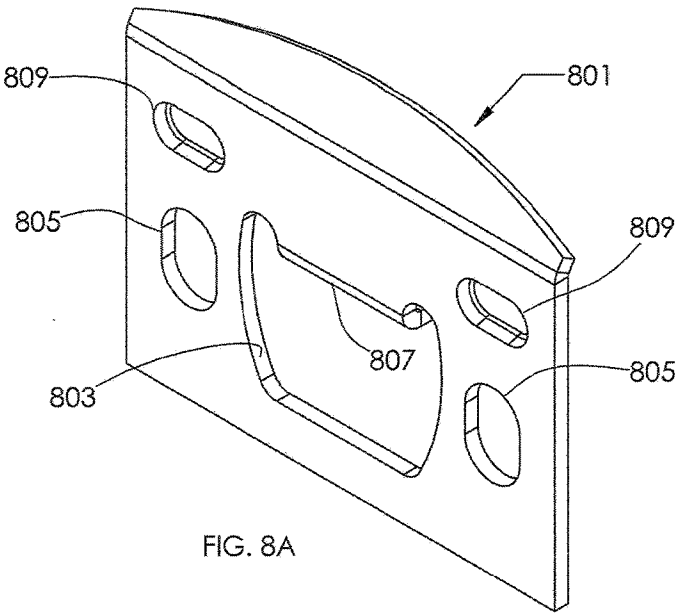
Figure 8B:
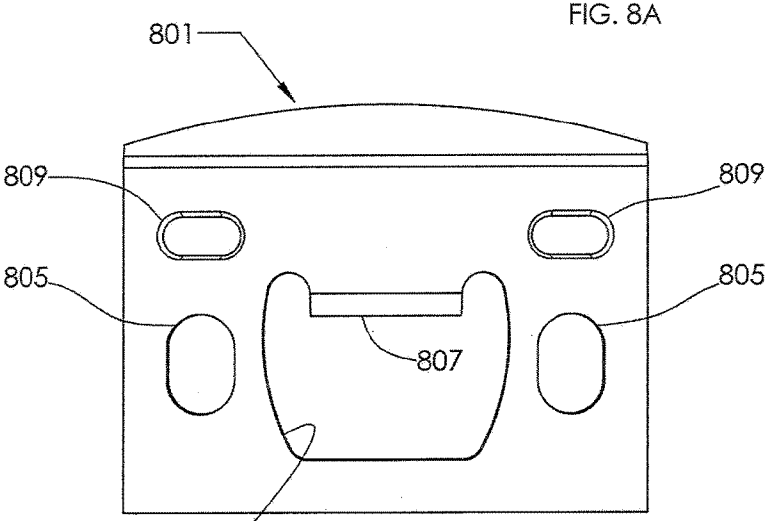
Figure 8C:
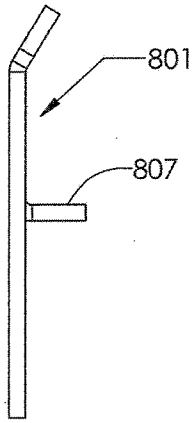

FIGS. 7A-7C and 8A-8C are perspective and orthographic views of a two-piece striker plate system according to an alternative embodiment of the present application, wherein FIGS. 7A-7C illustrate a bottom plate of the system and FIGS. 8A-8C illustrate a top plate of the system.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the two-piece striker plate system are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
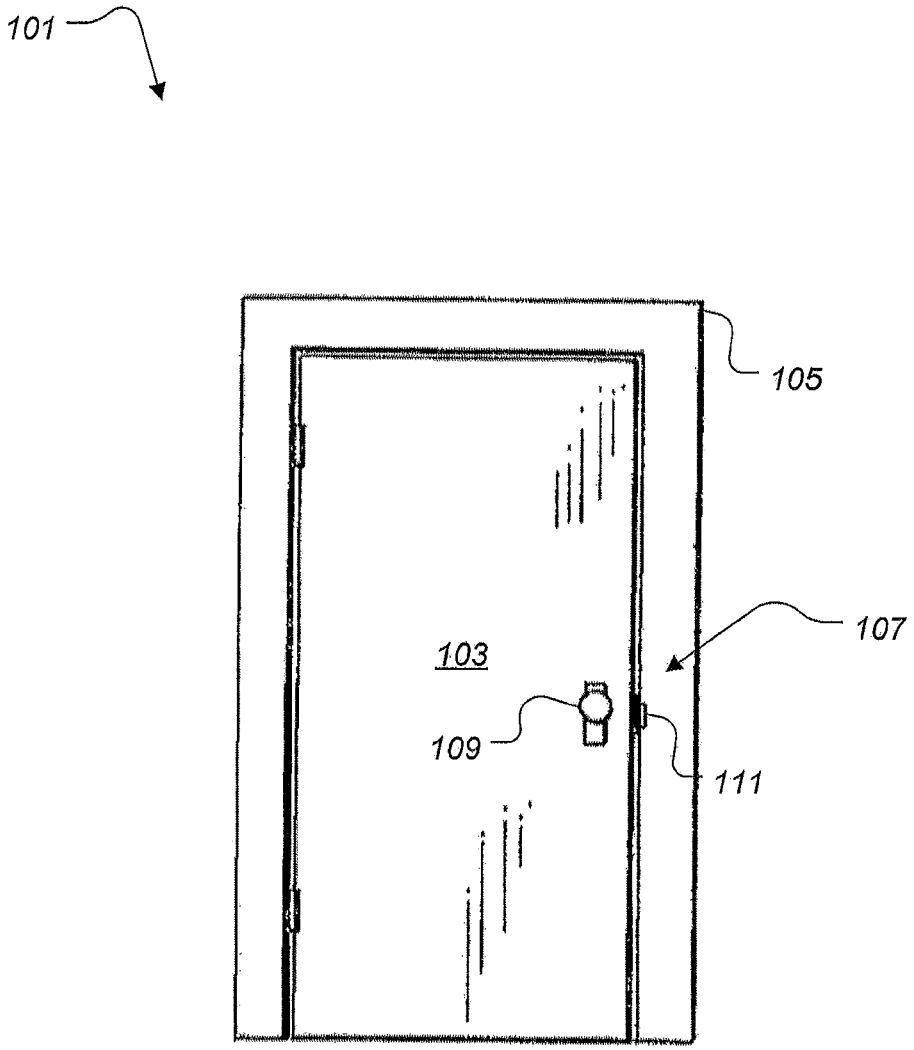
FIG. 1 is a plan view of a door using a two-piece striker plate according to the present application.

Referring now to FIG. 1 in the drawings, an embodiment of a door using a two-piece striker plate according to the present application is illustrated. Door system 101 is comprised of a door 103 hingedly coupled to a jamb 105 along with a lock system 107. Lock system 107 is comprised of a handle 109 rotationally coupled to a throw located inside the door 103 and a two-piece striker plate 111 attached to the jamb 105.

Figure 2A:
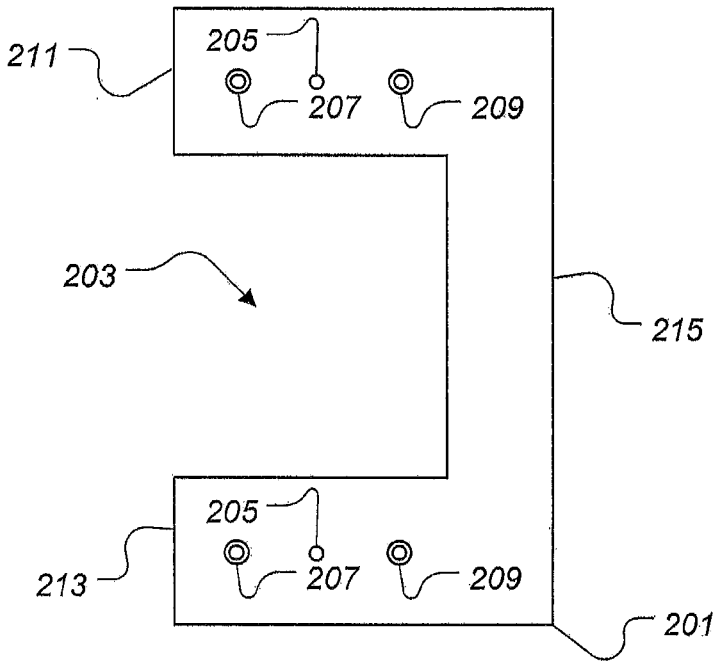
FIG. 2A is a front view of a bottom plate according to the present application.
Figure 2B:
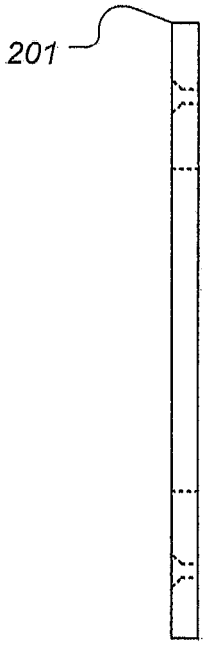
FIG. 2B is a side view of a bottom plate according to the present application.
Figure 2C:
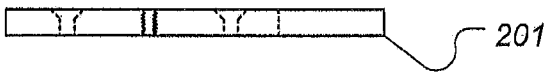
FIG. 2C is an end view of a bottom plate according to the present application.

Referring now also to FIGS. 2A-2C in the drawings, an embodiment of a lower plate according to the present application is illustrated. Lower plate 201 is comprised of a metallic plate with a notch 203, a pair of threaded holes 205, and a pair of countersunk through holes 207. Lower plate 201 alternatively further comprises an additional pair of opening 209 for additional strength between the lower plate and the jamb. Countersunk holes 207 allow a fastener to attach the lower plate to the jamb. Additional openings 209 provide further strength between the jamb and the lower plate when fastened with a nail or preferably a screw.

Lower plate 201 further comprises a first edge 211, a second edge 213, and a third edge 215. The first edge 211 and the second edge 213 are coaxial. Both the first edge 211 and second edge 213 are parallel to the third edge 215.

Figure 3A:
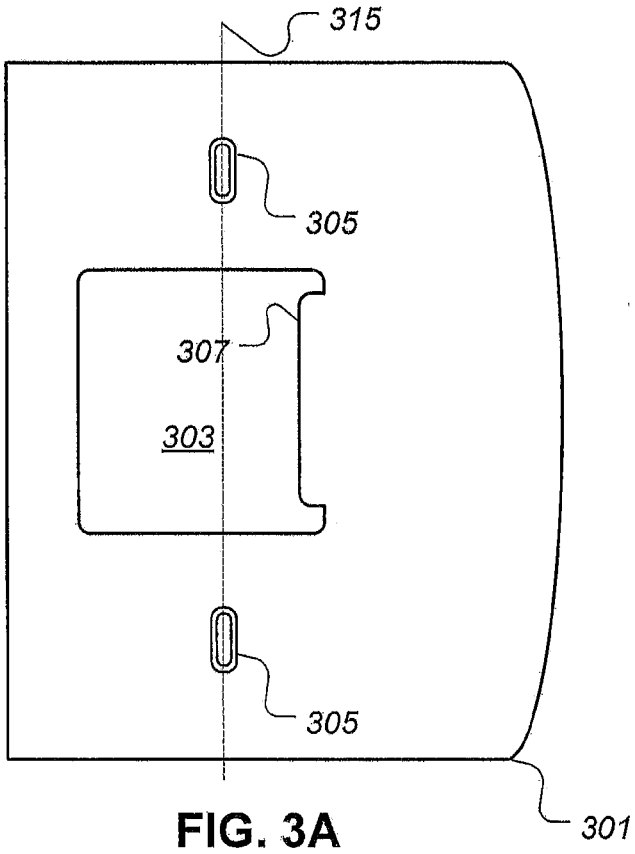
FIG. 3A is a front view of a top plate according to the present application.
Figure 3B:
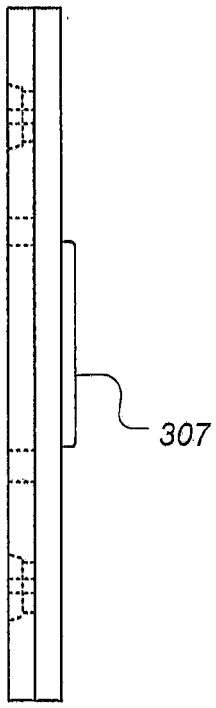
FIG. 3B is a side view of a top plate according to the present application.
Figure 3C:
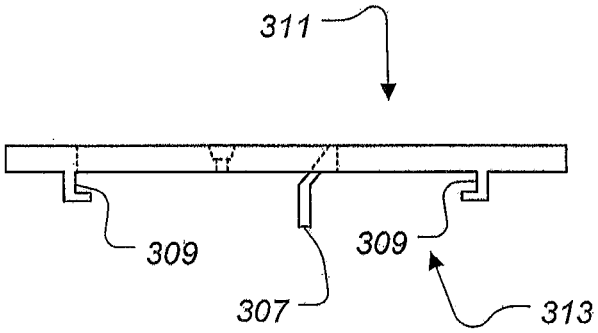
FIG. 3C is an end view of a top plate according to the present application.

Referring now also to FIGS. 3A-3C in the drawings, an embodiment of an upper plate according to the present application is illustrated. Upper plate 301 is comprised of an opening 303 or aperture, a pair of slotted openings 305, a lip 307, and a pair of channels 309. Slotted openings 305 are preferably countersunk such that a fastener located in the slotted opening is flush against an upper surface 311. Channels 309 are located on a lower surface 313 and are configured to retain the edges 211, 213, and 215 of the lower plate. The slotted openings 305 and the channels 309 allow the upper plate to translate relative to the lower plate along an axis of translation 315. This translation provides the user the ability to move the opening 303 to retain the throw of the lock. The axis of translation 315 is parallel to the third edge 215 of the lower plate.

Figure 4A:
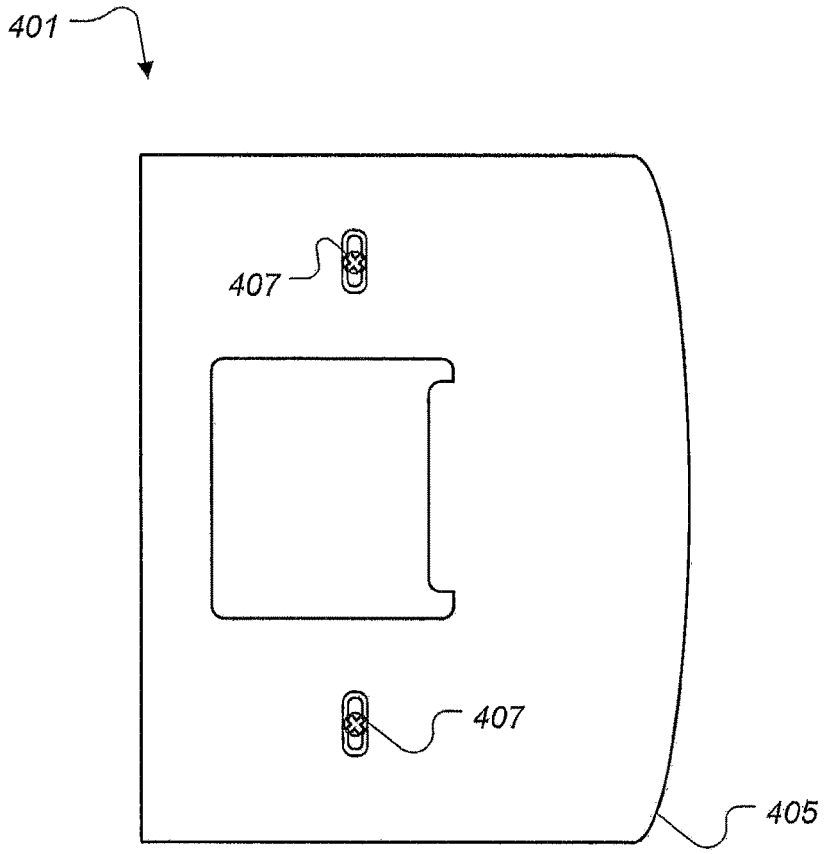
FIG. 4A is a front view of a two-piece striker plate system according to the present application.
Figure 4B:
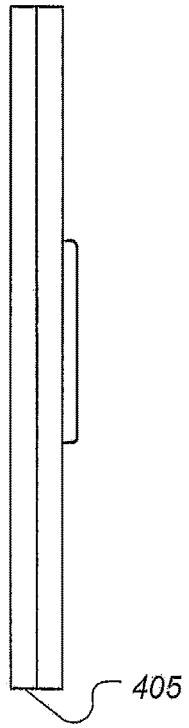
FIG. 4B is a side view of a two-piece striker plate system according to the present application.
Figure 4C:
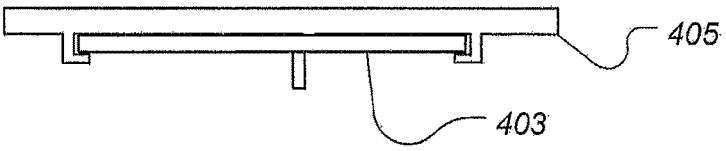
FIG. 4C is an end view of a two-piece striker plate system according to the present application.

Referring now also to FIGS. 4A-4C in the drawings, an embodiment of an upper plate according to the present application is illustrated. Two-piece striker system 401 is comprised of a lower plate 403, an upper plate 405, and at least two fasteners 407.

Figure 5A:
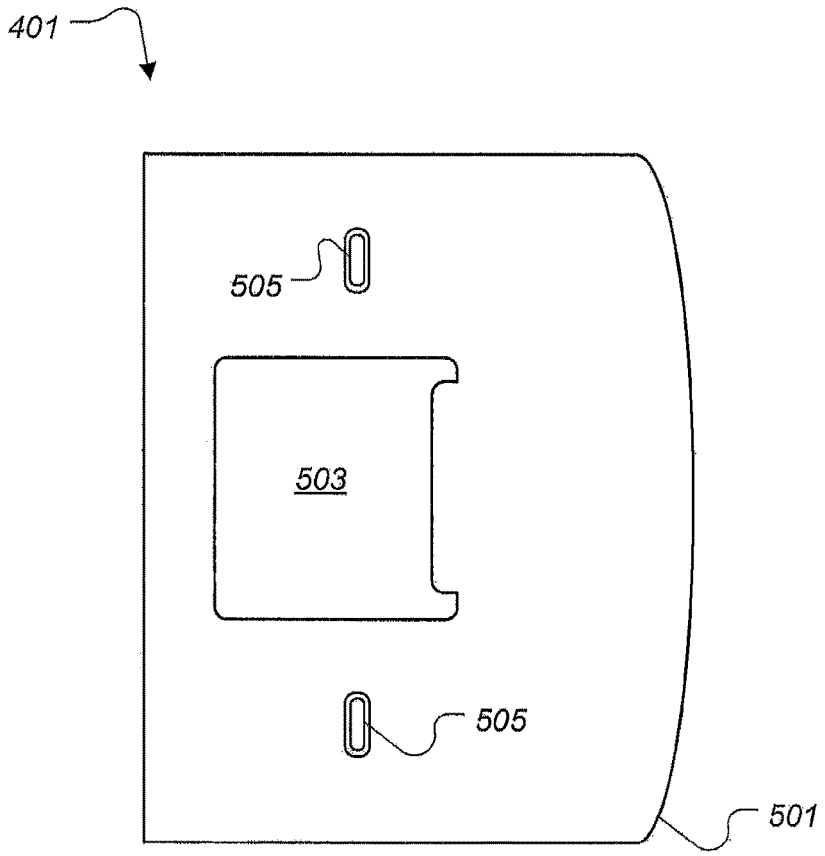
FIG. 5A is a front view of an alternative top plate according to the present application.
Figure 5B:
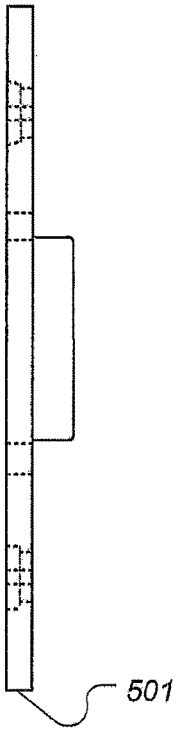
FIG. 5B is a side view of an alternative top plate according to the present application.
Figure 5C:
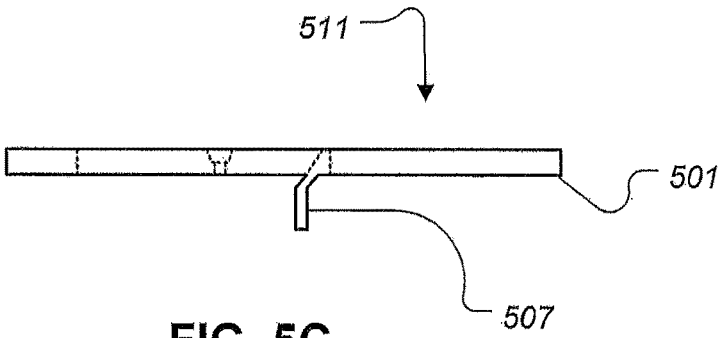
FIG. 5C is an end view of an alternative top plate according to the present application.

Referring now also to FIGS. 5A-5C in the drawings, an alternative embodiment of an upper plate according to the present application is illustrated. Upper plate 501 is comprised of an opening 503, a pair of slotted openings 505, and a lip 507. Slotted openings 505 are preferably countersunk such that a fastener located in the slotted opening is flush against an upper surface 511. The slotted openings 505 allow the upper plate to translate relative to the lower plate. This translation provides the user the ability to move the opening 503 to retain the throw of the lock as the lock/handle set is replaced over time.

Referring now also to FIGS. 6A-6C in the drawings, an alternative embodiment of an upper plate according to the present application is illustrated. Upper plate 601 is comprised of a first opening 603*a* or first aperture, a second opening 603*b* or second aperture, a pair of slotted openings 605, and lips 607. Slotted openings 605 are preferably countersunk such that a fastener located in the slotted opening is flush against an upper surface 611. The slotted openings 605 allow the upper plate to translate relative to the lower plate. This translation provides the user the ability to move the opening 603 to retain the throw of the lock as the lock/handle set is replaced over time. Upper plate 601 is configured for locksets having a handle set and a deadbolt. The first opening 603*a* receives the non-locking throw and the second opening 603*b* receives the throw from the deadbolt.

Referring now also to FIGS. 7A-7C in the drawings, an embodiment of a lower plate 701 according to an alternative embodiment of the present application is illustrated. Lower plate 701 is preferably formed from a metallic material, and includes an aperture or notch 703, a pair of threaded apertures 705, and a first pair of slotted openings 707. Slotted openings 707 are preferably countersunk to allow a first set of fasteners to pass therethrough, such that lower plate 701 may be adjusted along the length of slot openings 707 relative to the jamb. The first set of fasteners are preferably countersunk screws, so that the heads thereof remain flush with the surface of lower plate 701.

Referring now also to FIGS. 8A-8C in the drawings, an embodiment of an upper plate 801 according to an alternative embodiment of the present application is illustrated. Upper plate 801 is preferably formed from a metallic material, and includes an opening or aperture 803, a second pair of slotted openings 805, a lip 807, and a third pair of slotted openings 809. Second pair of slotted openings 805 and third pair of slotted openings 809 are preferably aligned at 90 degrees to each other; however, it will be appreciated that second pair of slotted openings 805 and third pair of slotted openings 809 may be aligned at different angles to each other, depending upon the desired application and direction of adjustment. Upper plate 801 is sized, shaped, and configured to mate with lower plate 701. It is preferred that neither opening of second pair of slotted openings 805 is countersunk. Second pair of slotted openings 805 is configured, located, and aligned with first pair of slotted openings 707 of lower plate 701, to allow access to first set of fasteners, which attach lower plate 701 to the jamb. However, slotted openings 809 are preferably countersunk to allow a second set of fasteners to pass therethrough and attach to threaded apertures 705. This configuration allows upper plate 801 to be releasably secured to lower plate 701 and to be adjusted along the length of slotted openings 809 relative to lower plate 701. The second fasteners are also preferably countersunk screws, so that the heads remain flush with the surface of upper plate 801.

Thus, a system and method having various embodiments for adjusting the location of a striker plate relative to the throw of a lock have been presented. The system involves two plates that translate relative to each other: a lower plate that attached to a door jamb, and an upper plate that adjusts relative to the lower plate. The lower plate is adjustably affixed to the jamb and the position of the upper plate may be adjusted relative to the lower plate, without having to remove the lower plate from the door jamb. This adjustable striker plate system provides users with the ability to maintain and adjust the striker plate over time to compensate for shifting and/or movement in the door jamb, wear in the locking system, and/or the changing out of locks.

This system is particularly well suited for use in commercial applications, such as apartment complexes. For example, a first lock is installed into a door having a throw. The lower, or fixed, plate is attached to the jamb of the door. The adjustable plate, or upper plate, is attached to the fixed plate and adjusted, so that the throw of the first lock is retained by the aperture of the upper plate. Over time, the first lock may be replaced with a second lock. The upper plate is then readjusted to retain the throw of the second lock in the aperture of the fixed plate, without having to remove the lower plate.

It is apparent that a system and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

I claim:

1. A striker plate system for a door jamb, comprising:

a lower plate comprising:

a notch;

a pair of threaded apertures; and a first pair of slotted openings configured to allow a first set of fasteners to pass therethrough for adjustably coupling the lower plate to the door jamb; and an upper plate configured to mate with the lower plate, the upper plate comprising:

an opening aligned with the notch;

a second pair of slotted openings aligned with the first pair of slotted openings of the lower plate; and a third pair of slotted openings aligned with the pair of threaded apertures, the third pair of slotted opening being configured to allow a second set of fasteners to pass therethrough into the threaded apertures of the lower plate, so as to adjustably secure the upper plate to the lower plate.

2. The striker plate system according to claim 1, wherein each slotted opening of the first pair of slotted openings in the lower plate is countersunk.

3. The striker plate system according to claim 1, wherein each slotted opening of the third pair of slotted openings in the upper plate is countersunk.

4. The striker plate system according to claim 1, wherein the upper plate further comprises:

a lip extending through the notch of the lower plate.

* * * * *